US007273402B2

(12) United States Patent
Mullings et al.

(10) Patent No.: US 7,273,402 B2
(45) Date of Patent: Sep. 25, 2007

(54) MARINE MOTOR BLADE SYSTEM

(75) Inventors: Kenneth Z. Mullings, Shreveport, LA (US); Ricky D. Womack, Shreveport, LA (US)

(73) Assignee: Innovative Outdoors, L.L.C., Shreveport, LA (US)

( * ) Notice: Subject to any disclaimer, the term of this patent is extended or adjusted under 35 U.S.C. 154(b) by 0 days.

(21) Appl. No.: 11/414,115

(22) Filed: Apr. 28, 2006

(65) Prior Publication Data

US 2006/0246792 A1 Nov. 2, 2006

Related U.S. Application Data

(60) Provisional application No. 60/676,615, filed on Apr. 29, 2005.

(51) Int. Cl.
*B63H 1/28* (2006.01)

(52) U.S. Cl. ..... 440/73; 416/146 R

(58) Field of Classification Search ..... 440/73; 416/146 R

See application file for complete search history.

(56) References Cited

U.S. PATENT DOCUMENTS 2,319,947 A * 5/1943 Oswood ..... 440/73
4,450,670 A * 5/1984 Robinson ..... 56/8
5,807,150 A * 9/1998 Minter, Sr. ..... 440/73

* cited by examiner

*Primary Examiner*—Stephen Avila
(74) *Attorney, Agent, or Firm*—Ted M. Anthony

(57) ABSTRACT

A blade system for mounting on a marine motor such as an electric trolling motor and cutting weeds, aquatic vegetation and other debris that normally entangle the submerged motor and propeller.

6 Claims, 5 Drawing Sheets

MARINE MOTOR BLADE SYSTEM

CROSS REFERENCES TO RELATED APPLICATIONS

This application claims the benefit of U.S. Provisional Patent Application Ser. No. 60/676,615 filed on Apr. 29, 2005.

STATEMENTS AS TO RIGHTS TO INVENTIONS MADE UNDER FEDERALLY SPONSORED RESEARCH AND DEVELOPMENT:

None

BACKGROUND OF THE INVENTION

1. Field of the Invention

The present invention relates to outboard motors and more particularly, to marine motors such as electric trolling motors. More particularly, the present invention relates to a device for affixing blades to such motors to cut submerged weeds, vines, water lily stems and like aquatic vegetation, as well as other debris such as discarded fishing line and the like, in a waterbody and minimize entanglement of the vegetation and/or other debris on the submerged motor and/or the propeller of such motor.

2. Description of the Prior Art

One of the problems associated with fishing and boating in various lakes, rivers and other waterways is aquatic vegetation which tends to entangle the propeller and lower propulsion unit of marine outboard motors. This problem is especially troublesome for marine motors of low horsepower, such as electric trolling motors. Among the worst of this entangling aquatic vegetation are water lily stems and submerged hydrilla or moss which grow from the bottom of the waterbody and extend upwardly to the surface of the waterbody in thick patches. Additionally, lengths of discarded fishing line and/or other debris can also obstruct waterways.

Such vegetation stems and strands and/or other debris quickly entangle an outboard motor propeller and lower propulsion unit and/or mount shaft by wrapping around the lower propulsion unit or mount shaft and the propeller, thereby requiring stopping of the motor, tilting of the lower propulsion unit upwardly and manually removing the vegetation or debris from the lower propulsion unit or mount shaft, as well as the propeller and propeller shaft. Problems with vegetation are particularly acute in southern lakes and rivers and other waterbodies where the water tends to be shallow in many areas and is quite troublesome for marine motors such as electric trolling motors, which have limited power and are widely used to propel a boat or watercraft in shallow water at slow speeds during fishing and other shallow water activities.

Accordingly, it is an object of this invention to provide one or more beneficial cutting blades mounted on the lower propulsion unit of an outboard motor, and particularly an outboard motor of low horsepower such as an electric trolling motor, to cut aquatic vegetation and/or other debris as the motor traverses such vegetation/debris in a lake, river or other waterbody.

SUMMARY OF THE INVENTION

These and other objects of the invention are provided in a blade system for clearing aquatic vegetation and other debris from the propellers of marine outboard motors, in general, and electric trolling motors, in particular. In the preferred embodiment, the present invention comprises an adjustable bracket that can be affixed to the outer surface of the submerged lower propulsion unit or electric motor housing of an outboard motor. Said bracket has a plurality of slots for receiving corresponding fixed knife blades to cut marine vegetation and/or other debris traversed by such submerged propulsion unit. In the preferred embodiment, said knife blades have at least two opposing serrated edges. Said blades are disposed within said slots along the outer surface of the submerged lower propulsion unit or electric motor housing of the outboard motor, and oriented so that said blades are positioned in proximity to the base of a spinning propeller. In the preferred embodiment, the cutting edges of such blades are oriented substantially parallel to the spinning axis of said propeller, and are offset so that the gap existing between the outer surface of the motor housing/propeller and the cutting surface(s) of such blades is reduced.

DETAILED DESCRIPTION OF THE PREFERRED EMBODIMENT

Figure 1:
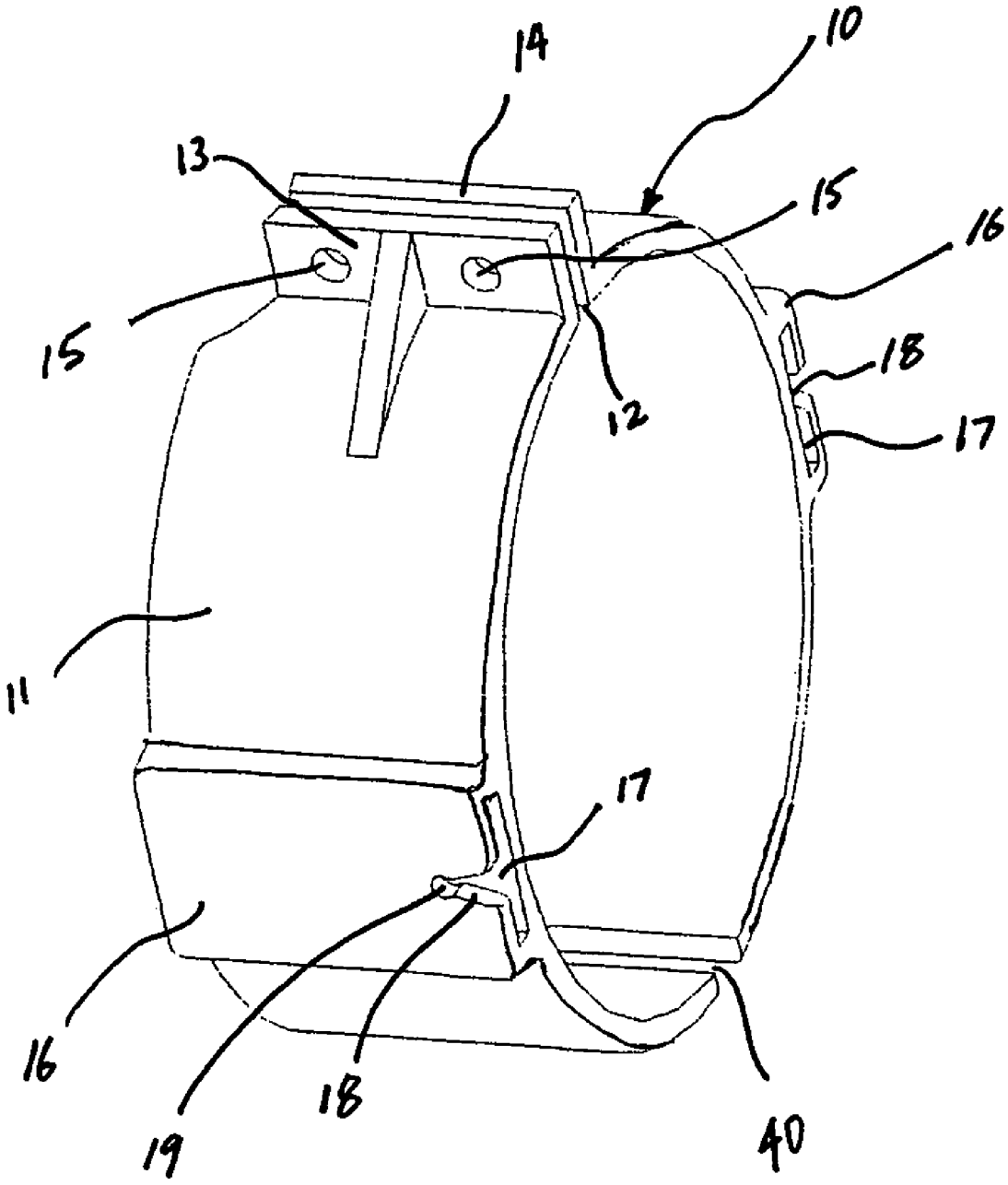
FIG. 1 depicts a side perspective view of an adjustable mounting bracket of the present invention.

FIG. 1 depicts a side perspective view of adjustable mounting bracket 10 of the present invention. Adjustable mounting bracket 10 of the present invention comprises substantially cylindrical central band 11. In the preferred embodiment, central band 11 is not continuous, and contains an elongate slot 12 which is oriented parallel to the longitudinal axis of central band 11; said elongate slot 12 defines two opposing edges. Upright members 13 and 14 extend outward from central band 11. Specifically, upright member 13 extends outward from one edge of central member 11 along elongate slot 12, while upright member 14 extends outward from opposing edge of central member 11 along elongate slot 12. In the preferred embodiment, said upright members 13 and 14 have substantially flat internal surfaces which can mate with one another. Aligned bores 15 extend through upright members 13 and 14 and are oriented perpendicular to elongate slot 12.

At least one blade housing 16 is disposed on the outer surface of central band 11. In the preferred embodiment, said blade housings 16 define slots 17 for receiving cutting blades of the present invention (not shown in FIG. 1). Also in the preferred embodiment, such housings 16, and the slots 17 formed by such housings are shaped to receive substantially planar cutting blades. It is to be observed that the basic geometry of such cutting blades, blade housings and related slots can be altered without departing from the concept of the present invention. Also in the preferred embodiment, blade housings 16 include elongate slots 18 and seats 19 for receiving locking nubs of cutting blades of the present invention (not shown in FIG. 1). Additionally, slot 40 is disposed along the base of cylindrical band 11.

Figure 2:
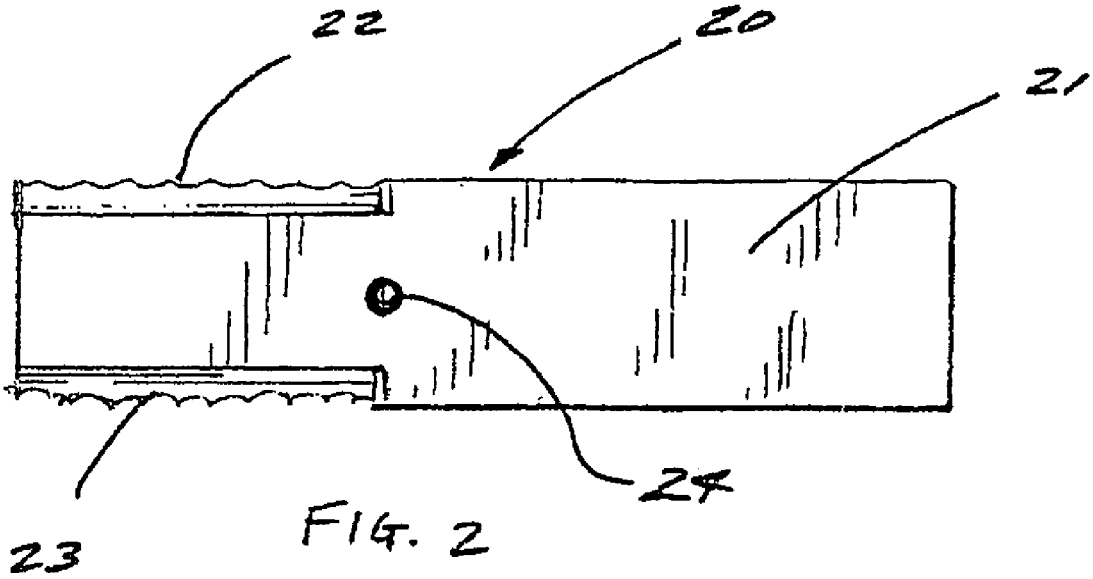
FIG. 2 depicts an top view of a blade of the present invention.

FIG. 2 depicts an overhead view of cutting blade 20 of the present invention. In the preferred embodiment, cutting blade 20 is substantially planar. Said cutting blade 20 has substantially flat base member 21, as well as serrated cutting edges 22 and 23. In the preferred embodiment, said cutting blade 20 has two opposing cutting surfaces 22 and 23 along the outer edges of cutting blade 20. Additionally, cutting blade 20 has locking nub 24 on the upper surface of said cutting blade 20.

Figure 3:
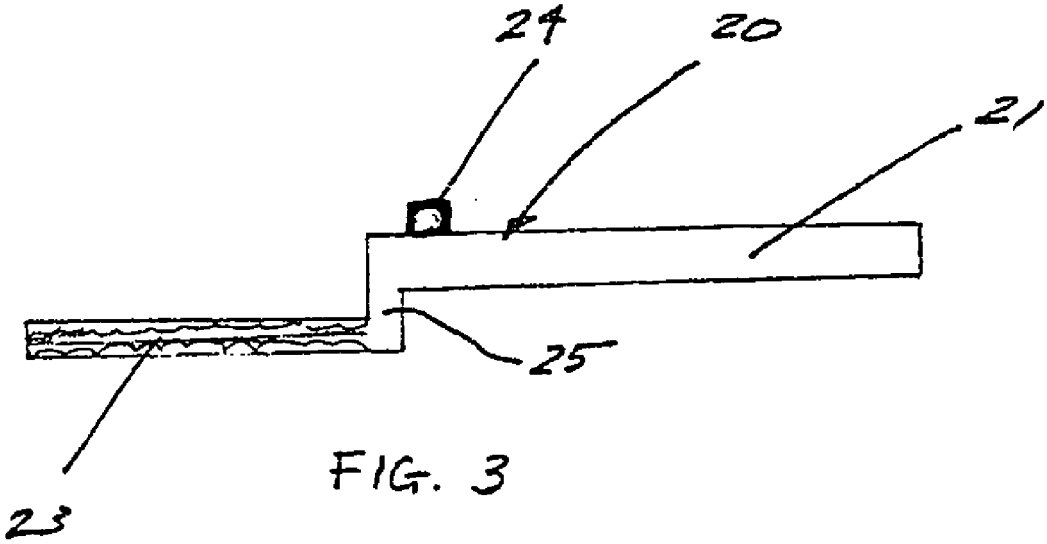
FIG. 3 depicts a side view of a blade of the present invention.

FIG. 3 depicts a side view of cutting blade 20 of the present invention. Cutting blade 20 has substantially flat base member 21, serrated cutting edge 23 (serrated cutting edge 22 is not visible in FIG. 3) and locking nub 24. In the preferred embodiment, extension member 25 is utilized to offset serrated cutting edges 22 (and 23) from base member 21.

Figure 4:
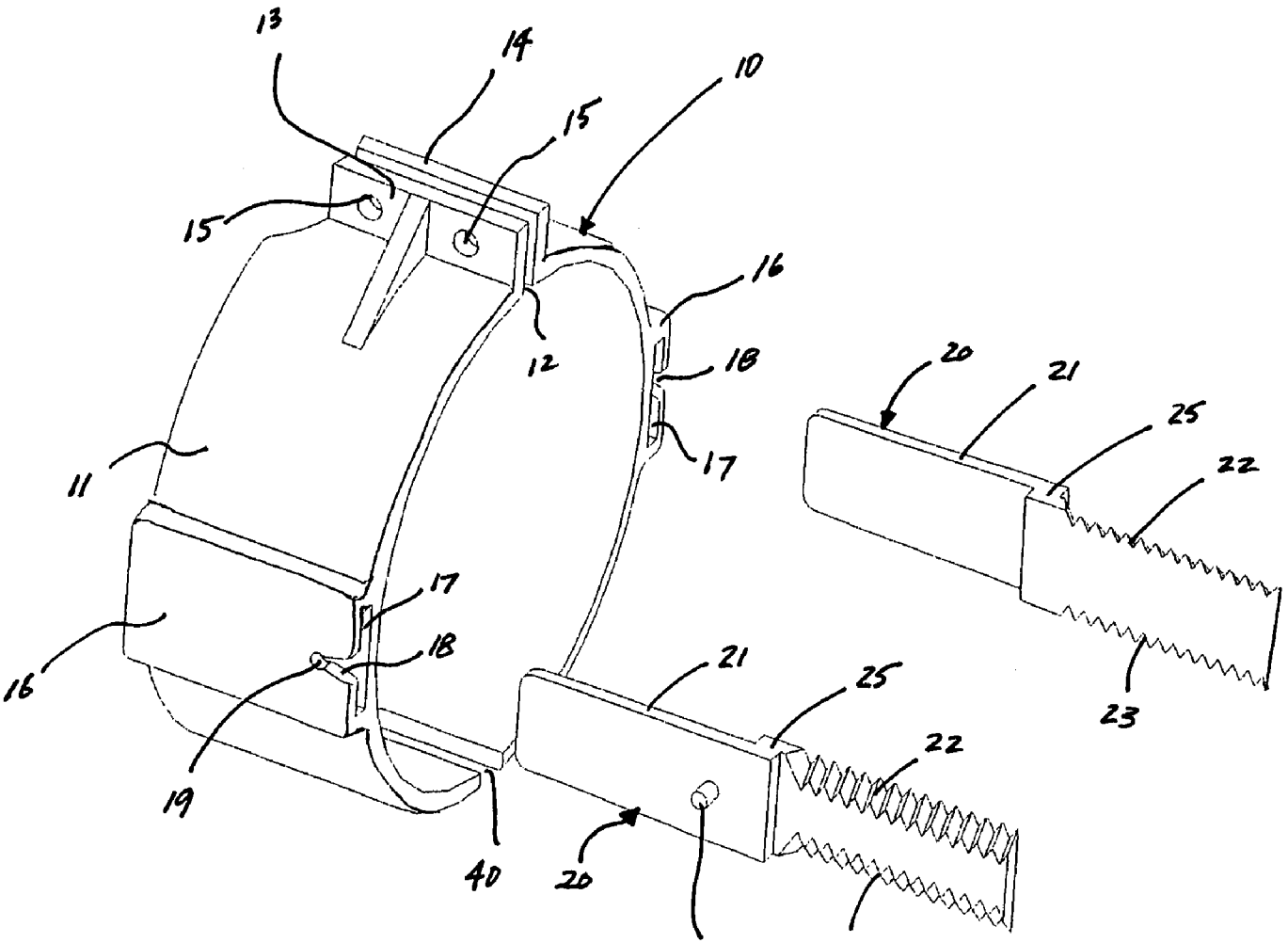
FIG. 4 depicts an exploded perspective view of the marine motor blade system of the present invention.

FIG. 4 depicts a side perspective view of the marine motor blade system of the present invention. Adjustable mounting bracket 10 of the present invention comprises substantially cylindrical central band 11. In the preferred embodiment, central band 11 is not continuous, and contains an elongate slot 12 which is oriented parallel to the longitudinal axis of central band 11; said elongate slot 12 defines two opposing edges. Upright members 13 and 14 extend outward from central band 11. Specifically, upright member 13 extends outward from one edge of central member 11 along elongate slot 12, while upright member 14 extends outward from opposing edge of central member 11 along elongate slot 12. In the preferred embodiment, said upright members 13 and 14 have substantially flat internal surfaces which can mate with one another. Aligned bores 15 extend through upright members 13 and 14 and are oriented perpendicular to elongate slot 12.

At least one blade housing 16 is disposed on the outer surface of central band 11. In the preferred embodiment, said blade housings 16 define slots 17 for receiving cutting blades of the present invention. Also in the preferred embodiment, such housings 16, and the slots 17 formed by such housings are shaped to receive substantially planar cutting blades. It is to be observed that the basic geometry of such cutting blades, blade housings and related slots can be altered without departing from the concept of the present invention. Also in the preferred embodiment, blade housings 16 include elongate slots 18 and seats 19 for receiving locking nubs of cutting blades of the present invention. Additionally, slot 40 is disposed along the base of cylindrical band 11.

Cutting blades 20 are substantially planar, and each have substantially flat base member 21, as well as serrated cutting edges 22 and 23. In the preferred embodiment, said cutting blades 20 each have two opposing cutting surfaces 22 and 23 along the outer edges of cutting blade 20. Additionally, cutting blades 20 each have locking nub 24 on the upper surface of said cutting blade 20. Each cutting blade 20 has substantially flat base member 21, serrated cutting edge 23 and locking nub 24 on one side. In the preferred embodiment, extension member 25 is utilized to offset serrated cutting edges 22 and 23 from base member 21.

Figure 5:
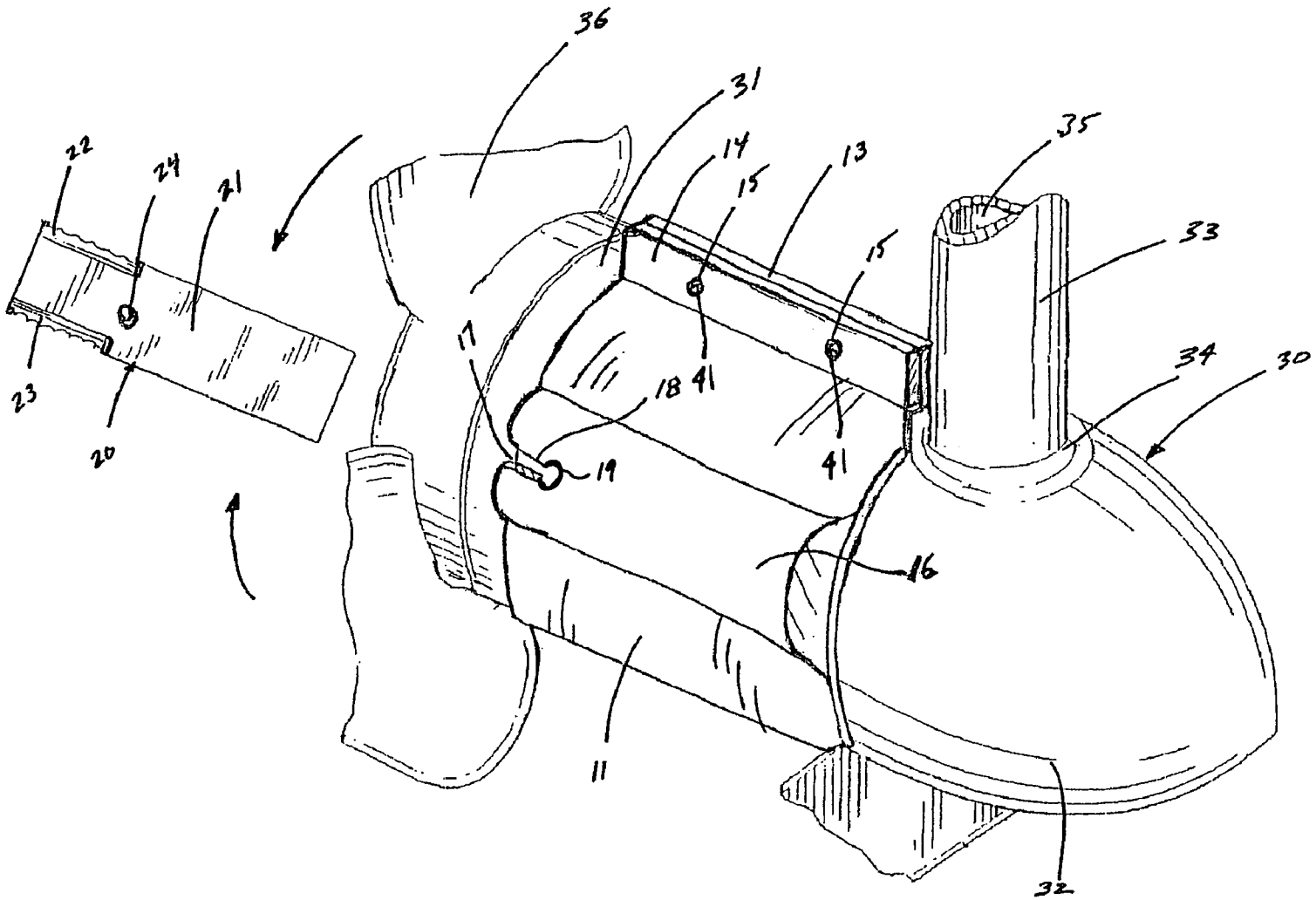
FIG. 5 depicts an exploded perspective view of the marine motor blade system of the present invention installed on a trolling motor.

FIG. 5 depicts an exploded perspective view of the marine motor blade system of the present invention installed on a trolling motor. Outboard motor 30 is typically an electric trolling motor and is characterized by a conventional submersible and removable motor housing 31, which is attached in water-sealing relationship to a conventional shaft mount 32, that receives a conventional motor mount shaft 33, typically by means of a shaft weld 34. The motor mount shaft 33 is further characterized by a shaft bore 35, through which suitable wiring (not illustrated) extends, in order to connect a drive motor, located inside motor housing 31, with a suitable control system (also not illustrated). A propeller 36 is mounted on a shaft (not illustrated) which projects from the rear of the drive motor within motor housing 31 by suitable techniques known to those skilled in the art. Accordingly, as the propeller 36 is driven and rotated by the drive motor, a force is generated.

Adjustable mounting bracket 10 of the present invention is mounted to said marine motor blade system. Specifically, substantially cylindrical central band 11 is fitted around the outer surface of motor housing 31. Upright members 13 and 14 are joined together in mating relationship, thereby substantially closing or reducing the gap formed by elongate slot 12. Fasteners 41 are inserted into aligned bores 15 and tightened to secure adjustable mounting bracket 10 around motor housing 31; although not specifically depicted in FIG. 5, fasteners 41 can be threaded bolts having mating threaded nuts (not shown in FIG. 5). Although depicted in an exploded view in FIG. 5, cutting blade 20 can be received within slot 17 formed by blade housing 16.

It is to be observed that adjustable mounting bracket 10 of the present invention can be designed in many different ways and still achieve the desired beneficial results. In the preferred embodiment, substantially cylindrical central band 11 is constructed of a rigid, yet bendable, material. Thus, elongate slot 12 of substantially cylindrical band 11 can be spread apart to allow said band to fit around motor housing 31. Once installed in the desired position, cylindrical central band 11 of adjustable mounting bracket 10 can be locked in position. It is to be observed that central band 11 could have a hinge mechanism or other configuration that would also yield the desired beneficial results without departing from the scope of the present invention.

Figure 6:
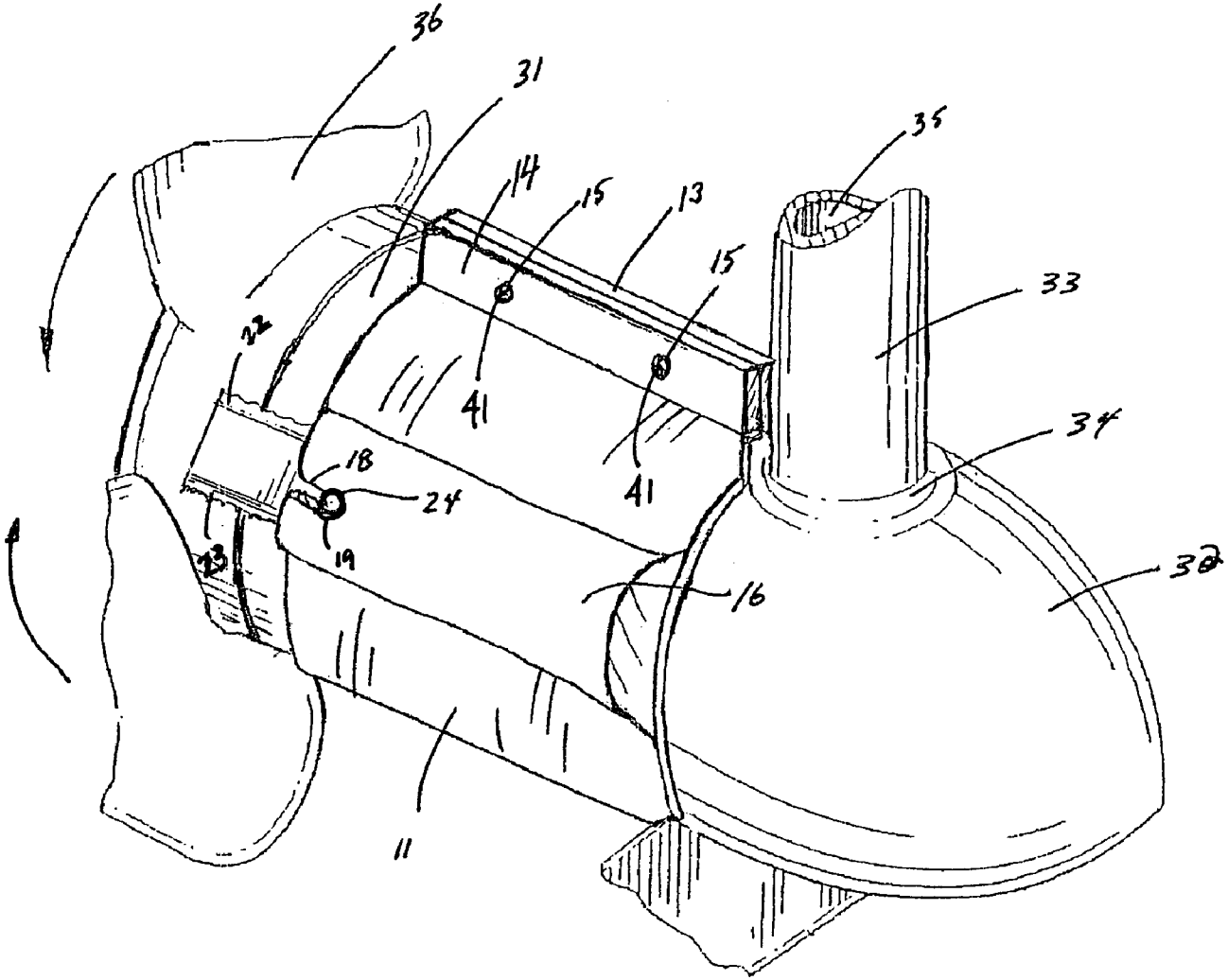
FIG. 6 depicts a perspective view of the marine motor blade system of the present invention installed on a trolling motor.

As illustrated in FIG. 6, cutting blades 20 extend from the open end of the blade housing 16, toward propeller 36. In the preferred embodiment of the invention, the ends of each of the serrated cutting edges 22 and 23 of cutting blade 20 terminate about one-half inch from the rotational plane of the leading edge of propeller 36, but may be adjustable in this respect. Each end of the respective serrated cutting edges 22 and 23 of cutting blade 20 are oriented in close proximity to motor housing 31 for optimum cutting of aquatic vegetation (not illustrated) and/or other debris which would normally entangle the motor housing 31 and propeller 36, as propeller 36 rotates or spins. The aquatic vegetation is cut as the rotating propeller forces the vegetation strands, and/or other debris against the serrated cutting edges 22 and 23 of cutting blades 20.

It is to be observed that cutting blades of the present invention can be quickly and efficiently removed and/or installed, as needed. As such the serrated edges of the blades become dull, said cutting blades can be quickly and easily changed in the field without the need for specialized tools or equipment. Although locking nub 24 engages within elongate slot 18 and seat 19 of blade housing 16 to anchor such cutting blade within seat 19, such cutting blades can be easily removed with minimal effort.

It is also to be noted that the present invention is capable of cutting vegetation or debris regardless of the direction that propeller 36 rotates. In other words, the present invention functions whether such propeller is spinning in a clockwise or counter-clockwise direction (that is, whether an attached boat is moving forward or in reverse).

It should also be observed that the present invention, and the shape of cutting blades 20 having offset member 25 in particular, permit the cutting surfaces of serrated cutting edges 22 and 23 to remain in close proximity to motor housing 31 and the base of propeller 36. Such design results in the distance between the motor housing/propeller and such cutting surfaces being minimized, thereby greatly improving cutting performance of the present invention.

It will be appreciated by those skilled in the art that the blade mount embodiments and variations of the blade system of this invention may be utilized on the propulsion unit of substantially any existing marine outboard motor. As a practical matter, the propulsion units of outboard motors having a relative small horsepower, such as electric trolling motors in particular, are more susceptible to application of the blade system of this invention, since these motors are so often used in shallow water where aquatic vegetation typically grows and debris can be found. However, the blade system of this invention, in all variations, may also be used on larger outboard motors, in order to prevent, or at least minimize, entanglement of this vegetation with the motor and/or propeller, under circumstances where the boat is moved from deep water into shallow water to approach a fishing area and while leaving the fishing area. These larger motors are then typically retracted such that the lower units clear the water, while a smaller motor such as an electric trolling motor, is used to traverse the area for fishing or other purposes. Accordingly, a very broad application for the various embodiments of the blade system of this invention, is to electric trolling motors which can be used in extremely shallow water to propel the boat or watercraft at slow speeds while fishing or for other purposes.

The above disclosed invention has a number of particular features which should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A blade system for cutting aquatic vegetation encountered by a marine motor having a propeller, comprising:

a. an adjustable bracket comprising:

i. a substantially cylindrical band having a transverse slot defining two opposing edges, wherein said substantially cylindrical band is bendable;

ii. a first upright member oriented along one edge of said slot, said first upright member having at least one aperture extending therethrough;

iii. a second upright member oriented on the opposite edge of said slot, wherein said second upright member has at least one aperture extending therethrough, and said at least one aperture of said second upright member is aligned with said at least one aperture of said first upright member; and iv. at least one mechanical fastener disposed through said aligned apertures;

b. at least one housing affixed to said bracket; and c. at least one blade slidably received within said at least one housing, wherein said at least one blade has first and second cutting edges, and said cutting edges are parallel to the rotational axis of said propeller.

2. The blade system of claim 1, wherein said first and second cuffing edges are serrated.

3. A blade system for cutting aquatic vegetation encountered by a marine motor having a propeller, comprising:

a. an adjustable bracket;

b. at least one housing affixed to said bracket;

c. at least one blade slidably received within said at least one housing, wherein said at least one blade comprises:

i. a substantially planar base member; and ii. a substantially planar cutting member having first and second cutting edges oriented parallel to the rotational axis of said propeller, wherein said base member and cutting member are offset relative to each other such that said cutting edges are proximate to said propeller.

4. A blade system for cutting aquatic vegetation encountered by a marine motor having a propeller, comprising:

a. an adjustable bracket comprising:

i. a substantially cylindrical band having a transverse slot defining two opposing edges, wherein said substantially cylindrical band is bendable;

ii. a first upright member oriented along one edge of said slot, said first upright member having at least one aperture extending therethrough;

iii. a second upright member oriented on the opposite edge of said slot, wherein said second upright member has at least one aperture extending therethrough, and said at least one aperture of said second upright member is aligned with said at least one aperture of said first upright member; and iv. mechanical fasteners disposed through said aligned apertures;

b. at least one housing having an opening;

c. at least one blade, slidably received within said at least one housing, wherein said at least one blade comprises:

i. a substantially planar base member; and ii. a substantially planar cutting member having first and second cutting edges, wherein said base member and said cutting member are offset relative to one another.

5. The blade system of claim 4, wherein said first and second cutting edges are serrated.

6. The blade system of claim 4, further comprising:

a. an elongate slot in said housing;

b. a seat disposed at one end of said elongate slot; and c. a nub disposed on the substantially planar base member of said at least one blade.

* * * * *